US007329095B2

(12) United States Patent
Wang

(10) Patent No.: US 7,329,095 B2
(45) Date of Patent: Feb. 12, 2008

(54) BLOWER CAPABLE OF REDUCING SECONDARY FLOW

(75) Inventor: Chung-Shu Wang, Taipei (TW)

(73) Assignee: Asia Vital Component Co., Ltd., Kaohsiung (TW)

( * ) Notice: Subject to any disclaimer, the term of this patent is extended or adjusted under 35 U.S.C. 154(b) by 193 days.

(21) Appl. No.: 10/959,974

(22) Filed: Oct. 8, 2004

(65) Prior Publication Data

US 2006/0078426 A1 Apr. 13, 2006

(51) Int. Cl.
*F01D 1/02* (2006.01)

(52) U.S. Cl. ..... 415/206; 415/224

(58) Field of Classification Search ..... 415/203, 415/204, 206, 224, 115, 116
See application file for complete search history.

(56) References Cited

U.S. PATENT DOCUMENTS 3,597,117 A * 8/1971 Zoehfeld ..... 417/354
5,839,879 A * 11/1998 Kameoka et al. ..... 415/206
6,551,059 B2 * 4/2003 Eimer et al. ..... 415/204
6,604,906 B2 * 8/2003 Ozeki et al. ..... 415/204
6,964,555 B2 * 11/2005 Ochiai et al. ..... 415/204
6,971,846 B2 * 12/2005 Ochiai et al. ..... 415/203
2005/0123398 A1 * 6/2005 Tam et al. ..... 415/211.2

* cited by examiner

*Primary Examiner*—Hoang Nguyen

(57) ABSTRACT

A blower capable of reducing secondary flow comprises a frame and a wheel blade part. The wheel blade part is mounted in the frame. The wheel blade part is composed of a hub and a plurality of blades surrounding the hub. The frame is composed of a base and an upper lid plate with a projection part being provided at inner side of the base. The projection part corresponds to the blades on the wheel blade part. A first guide part and a second guide part are provided at an air passage of the base near an opening thereof. The secondary flow produced in the blower can be reduced by way of the projection at the inner side of the base and the first and second guide parts at the air passage of the base near the opening thereof.

1 Claim, 4 Drawing Sheets

BLOWER CAPABLE OF REDUCING SECONDARY FLOW

BACKGROUND OF THE INVENTION

1. Field of the Invention

The present invention is related to a blower capable of reducing secondary flow and particularly to a frame device used in a blower.

2. Brief Description of the Related Art

Referring to FIGS. 1 and 2, the conventional blower 1 includes a frame 11 and a wheel blade part 12 disposed in the frame 11. The frame 11 is composed of a base 111 and an upper lid plate 112. The wheel blade part 12 is composed of a hub 121 and a plurality of blades 122 surrounding the hub 121.

Referring to FIG. 3, a distance results between the lower edges 122*a* of the blade 122 and the inner side 111*a* of the base 111 to produce a secondary flow at a space formed by the distance. The secondary flow can result in loud noise and block the airflow so as to reduce the overall air pressure and amount of the airflow.

Although the base 111 of the conventional blower 1 can be lifted the inner side 111*a* thereof to decrease the distance to the lower edges 122*a* of the blades 122 in order to reduce occurring the secondary flow, the inner space of the base 111 becomes smaller too to lead reduction of the overall air pressure and the amount of airflow.

SUMMARY OF THE INVENTION

An object of the present invention is to provide a blower capable of reducing secondary flow.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE INVENTION

Figure 1:
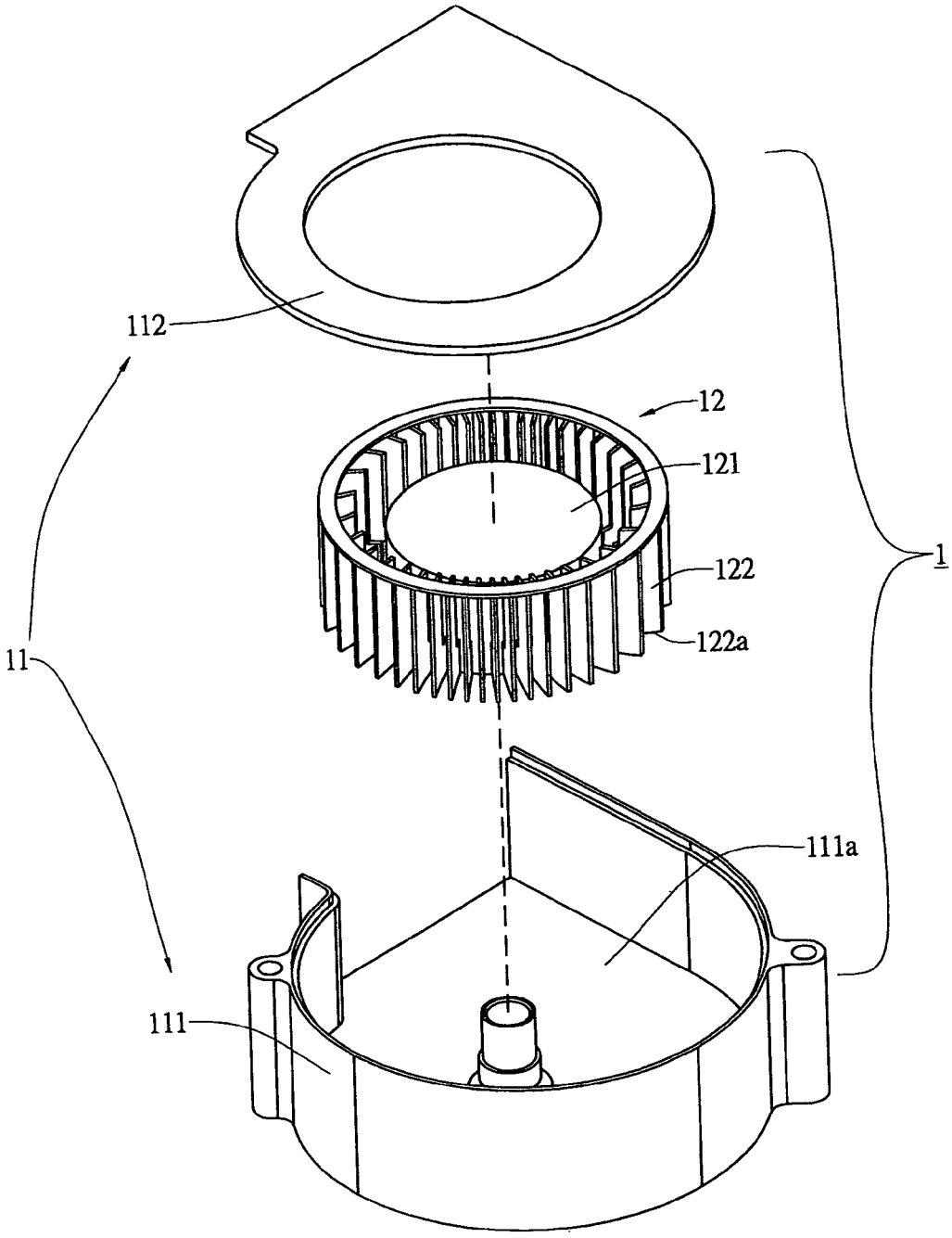
FIG 1 (PRIOR ART)
FIG. 1 is an exploded perspective view of a conventional blower.
Figure 2:
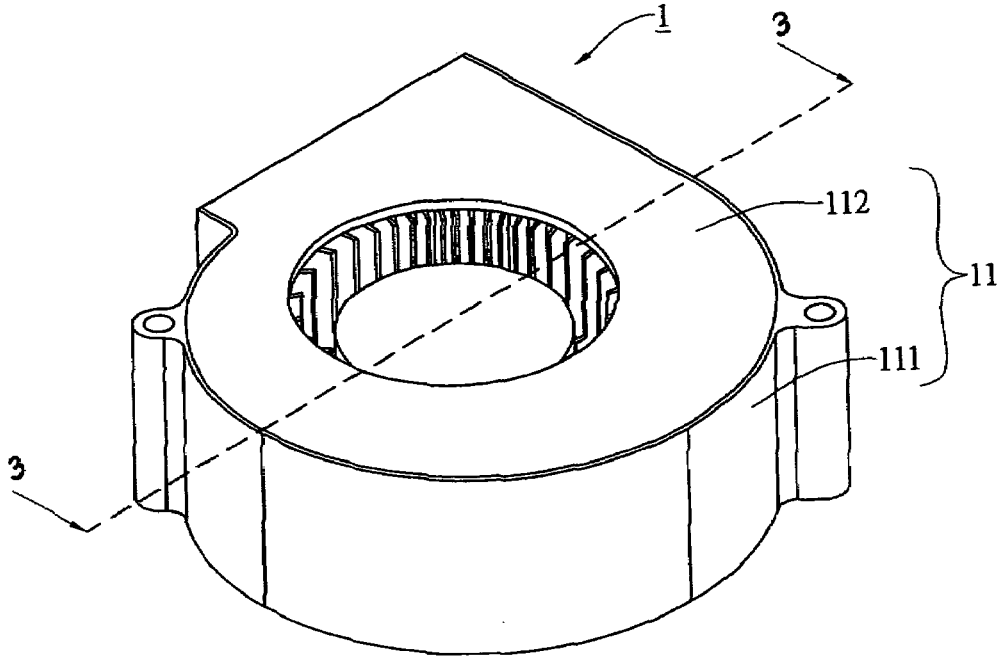
FIG 2 (PRIOR ART)
FIG. 2 is an assembled perspective view of the conventional blower.
Figure 3:
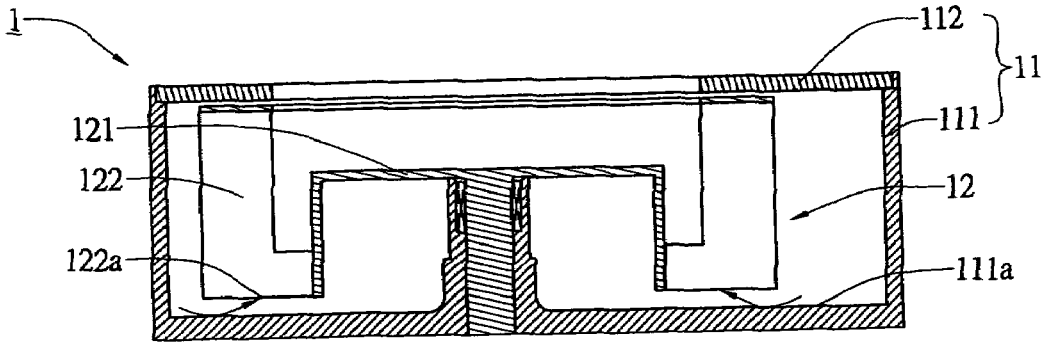
FIG 3 (PRIOR ART)
FIG. 3 is a sectional view along line 3-3 shown in FIG. 2.
Figure 4:
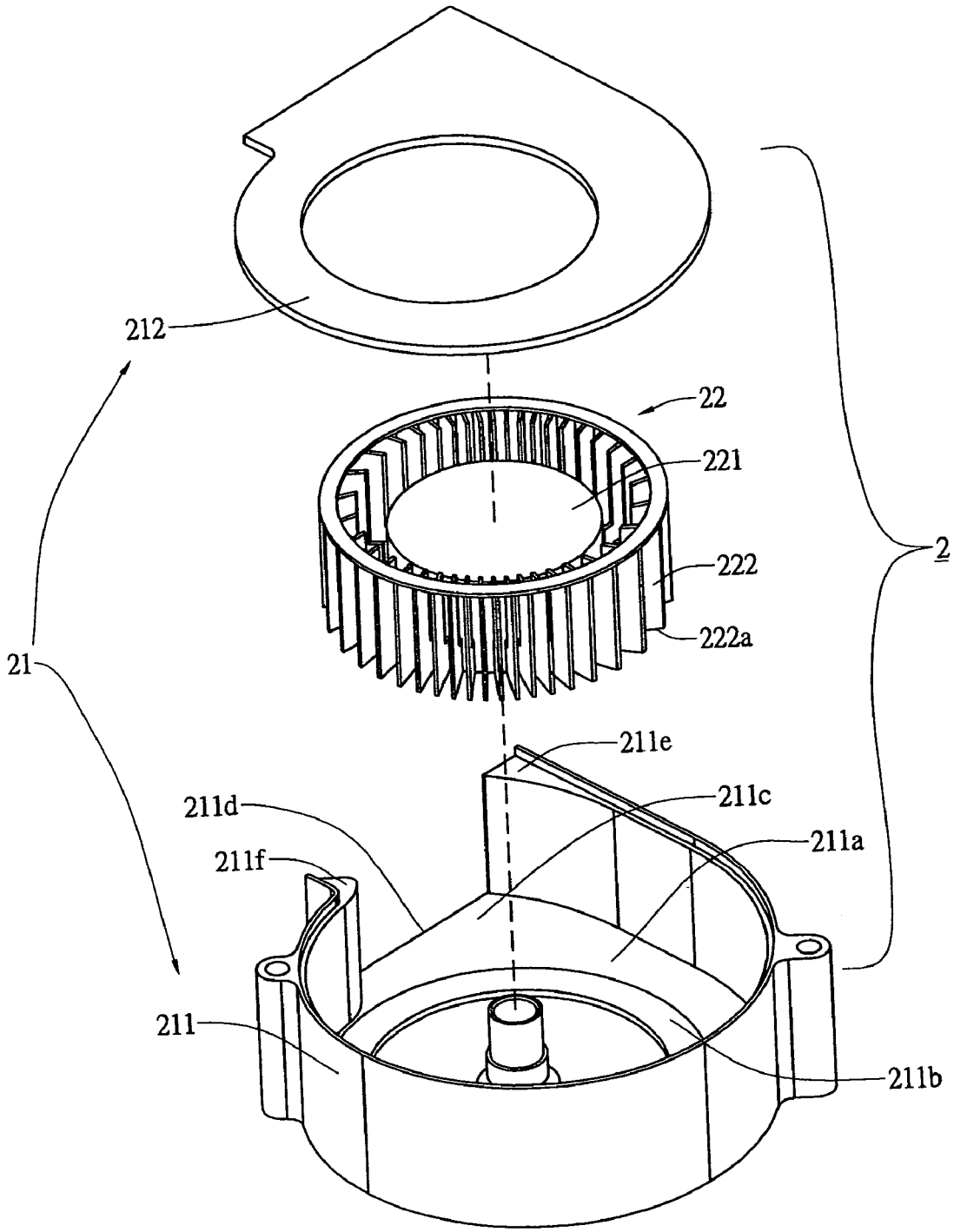
FIG. 4 is an exploded perspective view of the blower according to the present invention.
Figure 5:
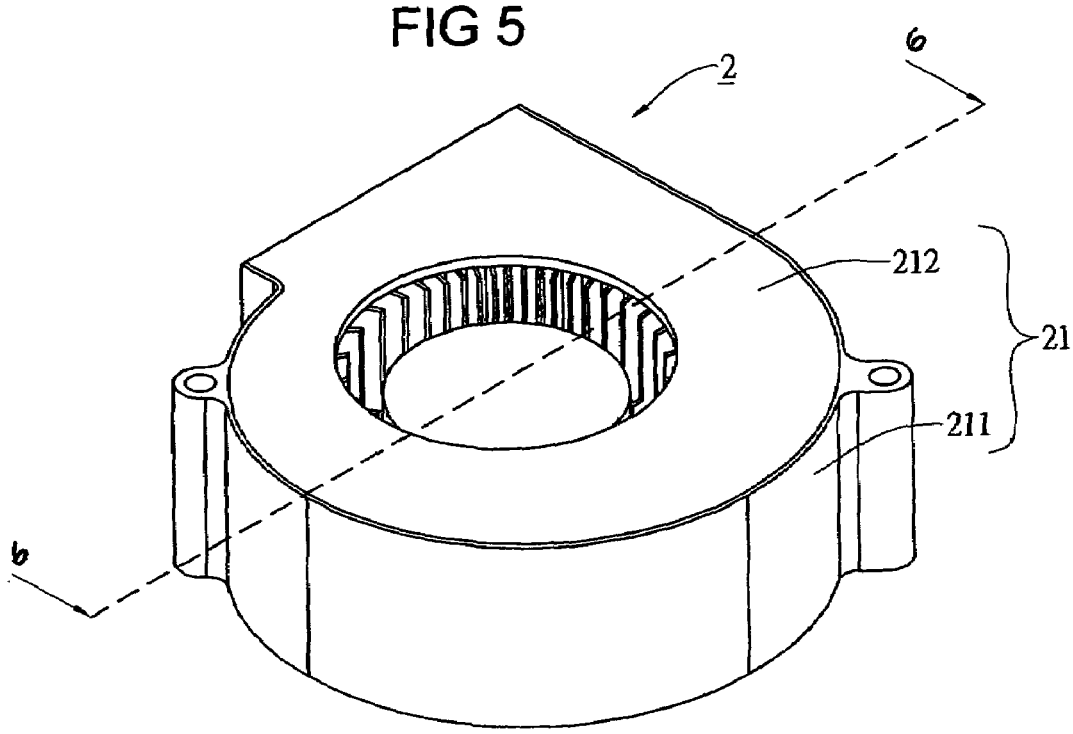
FIG. 5 is an assembled perspective view of the blower according to the present invention.

Referring to FIGS. 4 and 5, a blower 2 according to the present invention comprises a frame 21 and a wheel blade part 22. The wheel blade part 22 is composed of a hub 221 and a plurality of blades 222 surrounding the hub 221. The frame 21 is composed of a base 211 and an lid plate 212 and base 211 has a circular sham, periphery wall 211 and a base part at 211*a*. The base part 211*a* is disposed at the bottom of the periphery wall 211 and an axial barrel extends from the base part 211*a* to fit with the hub 221 such that an elevation space is formed between the wheel blade part 22 and the base part 211*a*. An annular projection part 211*b* is disposed at the base part 211*a* surrounding the axial barrel to extend toward the elevational space such that a clearance is formed between the annular projection the lower edges 222*a* of the blades 222 on the wheel blade part 22.

Figure 6:
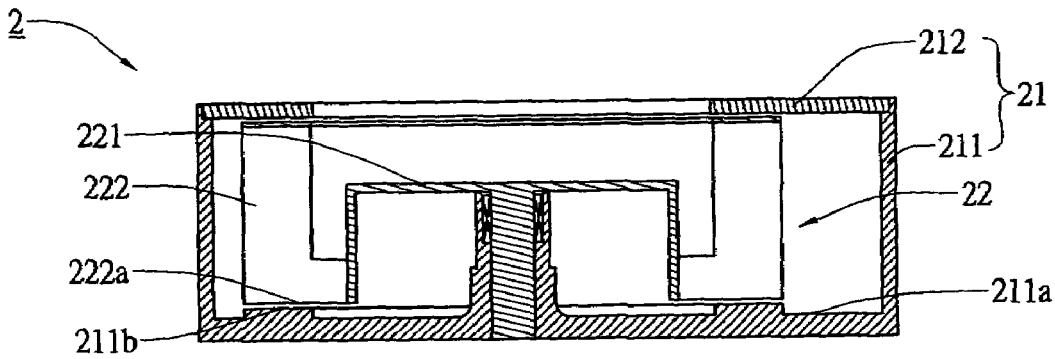
FIG. 6 is a sectional view along line 6-6 according to the present invention.

Referring to FIG. 6, the projection part 211*b* reduces the distance between the lower edges 222*a* and the inner side 211*a* to the least extent and partitions the distance. When the wheel blade part 22 rotates, the airflow introduced by the blades 222 can be restricted by the projecting part 211*b* to allow the airflow being not easy to constitute secondary flow in the elevational space between the wheel blade part 222 and base part 211*a* of the base 211.

Referring to FIGS. 3 to 6, the projection part 211*b* at the inner side of the base 211 can overcome the deficiency of excessive large distance between the lower edges 122*a* of the blades 122 producing the secondary flow. In addition, the air pressure and airflow are increased at the opening 211*d* provided at the base 211.

Besides, a first guide part 211*e* and a second guide part 211*f* can be provided at two lateral sides of the opening 211*d* of the periphery wall of the base 211. The respective guide part 211*e*. 211*f* has a shape similar to a wedge to guide the air so as to reduce noise created by the wheel blade part 22 of the blower 2 during running.

While the invention has been described with referencing to the preferred embodiment thereof, it is to be understood that modifications or variations may be easily made without departing from the spirit of this invention, which is defined by the appended claims.

What is claimed is:

1. A blower capable of reducing secondary flow comprising:

a frame, providing a base with a periphery wall and an upper lid plate covering the base, an axial barrel extending from the base and having an opening at the periphery wall; and a wheel blade part, being received in the frame, providing a hub to fit with the axial barrel and having a plurality of blades surrounding the hub such that an elevational space is formed between the base and the fan blade part;

characterized in that the inner side of the periphery wall next to two opposite sides of the opening is attached to a first guide part and a second guide part respectively and the first guide part provides a long-curved-wedge shape and the second guide part provides short-curved-wedge shape for reducing noise during the wheel blade part running.

* * * * *